US007883592B2

(12) United States Patent
Hofmann et al.

(10) Patent No.: US 7,883,592 B2
(45) Date of Patent: Feb. 8, 2011

(54) SEMI-SOLID PROCESSING OF BULK METALLIC GLASS MATRIX COMPOSITES

(75) Inventors: Douglas C. Hofmann, Pasadena, CA (US); William C. Johnson, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 380 days.

(21) Appl. No.: 12/059,523

(22) Filed: Mar. 31, 2008

(65) Prior Publication Data

US 2009/0000707 A1 Jan. 1, 2009

Related U.S. Application Data

(60) Provisional application No. 60/922,194, filed on Apr. 6, 2007.

(51) Int. Cl.
*C22F 1/18* (2006.01)
*C22C 45/10* (2006.01)

(52) U.S. Cl. ..... 148/561; 148/672

(58) Field of Classification Search ..... 148/538, 148/561

See application file for complete search history.

(56) References Cited

U.S. PATENT DOCUMENTS

| | | | |
|---|---|---|---|
| 2,190,611 | A | 2/1940 | Sembdner |
| 4,115,682 | A | 9/1978 | Kavesh et al. |
| 4,289,009 | A | 9/1981 | Festag et al. |
| 4,330,027 | A | 5/1982 | Narasimhan |
| 4,472,955 | A | 9/1984 | Nakamura et al. |
| 4,529,457 | A | 7/1985 | Kushnick |
| 4,621,031 | A | 11/1986 | Scruggs |
| 4,710,235 | A | 12/1987 | Scruggs |
| 4,854,370 | A | 8/1989 | Nakamura |
| 4,990,198 | A | 2/1991 | Masumoto et al. |
| 5,032,196 | A | 7/1991 | Masumoto et al. |
| 5,035,084 | A | 7/1991 | Towns |

(Continued)

FOREIGN PATENT DOCUMENTS

| | | |
|---|---|---|
| EP | 0 494 688 B1 | 7/1992 |

(Continued)

OTHER PUBLICATIONS

Hays, C.C., et al., "Microstructure Controlled Shear Band Pattern Formation and Enhanced Plasticity of Bulk Metallic Glasses Containing in situ Formed Ductile Phase Dendritic Dipersions", Physical Review Letters, vol. 84, No. 13, Mar. 27, 2000.*

(Continued)

*Primary Examiner*—George Wyszomierski
(74) *Attorney, Agent, or Firm*—Kauth, Pomeroy, Peck & Bailey LLP

(57) ABSTRACT

A method of forming bulk metallic glass engineering materials, and more particularly a method for forming coarsening microstructures within said engineering materials is provided. Specifically, the method forms 'designed composites' by introducing 'soft' elastic/plastic inhomogeneities in a metallic glass matrix to initiate local shear banding around the inhomogeneity, and matching of microstructural length scales (for example, L and S) to the characteristic length scale $R_P$ (for plastic shielding of an opening crack tip) to limit shear band extension, suppress shear band opening, and avoid crack development.

25 Claims, 12 Drawing Sheets

U.S. PATENT DOCUMENTS

Figure 1:
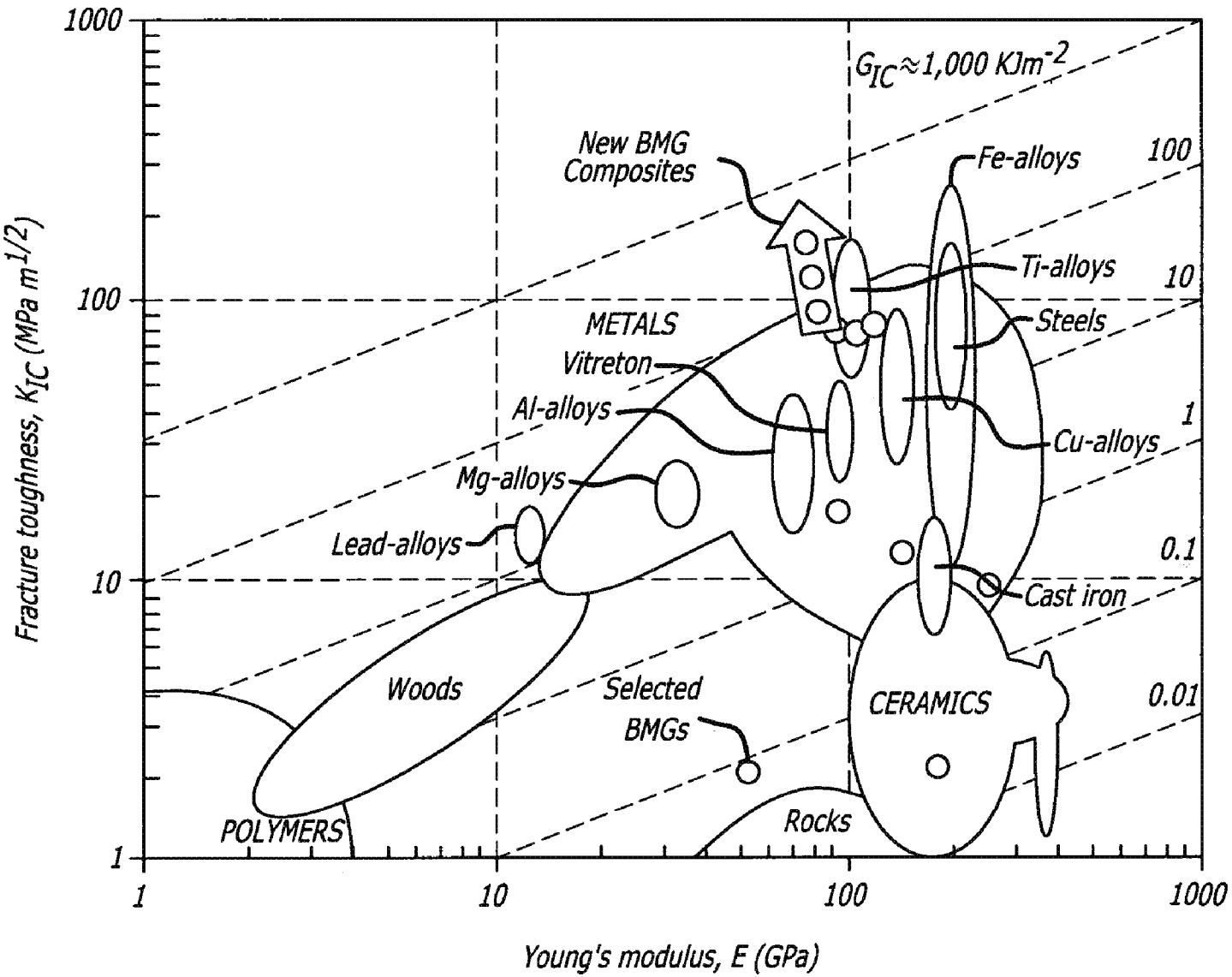

| | | | |
|---|---|---|---|
| 5,035,085 | A | 7/1991 | Mamelson et al. |
| 5,074,935 | A | 12/1991 | Masumoto et al. |
| 5,117,894 | A | 6/1992 | Katahira |
| 5,131,279 | A | 7/1992 | Lang et al. |
| 5,169,282 | A | 12/1992 | Ueda et al. |
| 5,209,791 | A | 5/1993 | Masumoto et al. |
| 5,213,148 | A | 5/1993 | Masumoto et al. |
| 5,225,004 | A | 7/1993 | O'Handley et al. |
| 5,279,349 | A | 1/1994 | Horimura |
| 5,288,344 | A | 2/1994 | Peker et al. |
| 5,296,059 | A | 3/1994 | Masumoto et al. |
| 5,306,463 | A | 4/1994 | Horimura |
| 5,312,495 | A | 5/1994 | Masumoto et al. |
| 5,324,368 | A | 6/1994 | Masumoto et al. |
| 5,361,826 | A | 11/1994 | Yamauchi et al. |
| 5,368,659 | A | 11/1994 | Peker et al. |
| 5,390,724 | A | 2/1995 | Yamauchi et al. |
| 5,482,580 | A | 1/1996 | Scruggs et al. |
| 5,564,994 | A | 10/1996 | Chang |
| 5,567,251 | A | 10/1996 | Peker et al. |
| 5,589,012 | A | 12/1996 | Hobby et al. |
| 5,618,359 | A | 4/1997 | Lin et al. |
| 5,711,363 | A | 1/1998 | Scruggs et al. |
| 5,735,975 | A | 4/1998 | Lin et al. |
| 5,740,854 | A | 4/1998 | Inoue et al. |
| 5,797,443 | A | 8/1998 | Lin et al. |
| 5,896,642 | A | 4/1999 | Peker et al. |
| 5,950,704 | A | 9/1999 | Johnson et al. |
| 6,027,586 | A | 2/2000 | Masumoto et al. |
| 6,652,679 | B1 | 11/2003 | Inoue et al. |
| 6,669,793 | B2 | 12/2003 | Hays |
| 6,709,536 | B1 | 3/2004 | Kim et al. |
| 7,056,394 | B2 | 6/2006 | Inoue et al. |
| 7,090,733 | B2 | 8/2006 | Munir et al. |
| 2003/0000601 | A1 | 1/2003 | Shimizu et al. |
| 2008/0209794 | A1 * | 9/2008 | Anderson ..... 43/43.16 |

FOREIGN PATENT DOCUMENTS

| | | | |
|---|---|---|---|
| GB | 2 236 325 | A | 4/1991 |
| JP | 61238423 | A | 10/1986 |

OTHER PUBLICATIONS

Flores et al., "Local Heating Associated with Crack Tip Plasticity in Zr-Ti-Ni-Cu-Be Bulk Amorphous Metals", J. Mater. Res, 1999, vol. 14, No. 638, pp. 1-12.
Ashby et al., "Metallic glasses of structural materials", Scripta Materialia, 2006, vol. 54, pp. 321-326.
Chen et al., "Extraordinary Plasticity of Ductile Bulk Metallic Glasses", Physical Review Letters, Jun. 23, 2006, vol. 96, pp. 245502-1-245502-4.
Conner et al., "Shear bands and cracking of metallic glass plates in bending", Journal of Applied Physics, Jul. 15, 2003, vol. 94, No. 2, pp. 904-911.
Das et al., ""Work-Hardenable" Ductile Bulk Metallic Glass", Physical Review Letters, May 27, 2005, vol. 94, pp. 205501-1-205501-4.
Eckert et al., "High strength ductile Cu-base metallic glass", Intermetallics, 2006, vol. 14, pp. 867-881.
Eckert et al., "Structural bulk metallic glasses with different length-scale of constituent phases", Intermetallics, 2002, vol. 10, pp. 1183-1190.
Fan et al., "Ductility of bulk nanocrystalline composites and metallic glasses at room temperature", Applied Physics Letters, Jul. 3, 2000, vol. 77, No. 1, pp. 46-48.
Greer, "Metallic Glasses", Science, Mar. 31, 1995, vol. 267, pp. 1947-1953.
Hays et al., "Microstructure Controlled Shear Band Pattern Formation and Enhanced Plasticity of Bulk Metallic Glasses Containing in situ Formed Ductile Phase Dendrite Dispersions", Physical Review Letters, Mar. 27, 2000, vol. 84, No. 13, pp. 2901-2904.
He et al., "Microstructure and mechanical properties of the Zr66.4Cu10.5Ni8.7A18Ta6.4 metallic glass-forming alloy", Scripta Materialia, 2003, vol. 48, pp. 1531-1536.
Hofmann et al., "TEM study of structural evolution in a copper mold cast Cu46Zr54 bulk metallic glass", Scripta Materialia, 2006, vol. 54, pp. 1117-1122.
Lee et al., "A development of Ni-based alloys with enhanced plasticity", Intermetallics, 2004, vol. 12, pp. 1133-1137.
Lee et al., "Effect of a controlled volume fraction of dendrite phases on tensile and compressive ductility in La-based metallic glass matrix composites", Acta Materialia, 2004, vol. 52, pp. 4121-4131.
Lee et al., "Mechanical behavior of Ni-based metallic glass matrix composites deformed by cold rolling", Materials Letters, 2004, vol. 58, pp. 3312-3315.
Lewandowski et al., "Intrinsic plasticity or brittleness of metallic glasses", Philosophical Magazine Letters, Feb. 2005, vol. 85, No. 2, pp. 77-87.
Liang et al., "Rubber Toughening in Polypropylene: A Review", Journal of Applied Polymer Science, 2000, vol. 77, pp. 409-417.
Liu et al., "Super Plastic Bulk Metallic Glasses at Room Temperature", Science, Mar. 9, 2007, vol. 315, pp. 1385-1388.
Peker et al., "A highly processable metallic glass: Zr41.2Ti13.8Cu12.5Ni10.0Be22.5", Appl. Phys. Lett., Oct. 25, 1993, vol. 63, No. 17, pp. 2342-2344.
Rao et al., "Preparation and mechanical properties of a new Zr-A1-Ti-Cu-Ni-Be bulk metallic glass", Materials Letters, 2001, vol. 50, pp. 279-283.
Salimon et al., "Bulk metallic glasses: what are they good for?", Materials Science and Engineering, 2004, vol. A, Nos. 375-377, pp. 385-388.
Schroers et al., "Ductile Bulk Metallic Glass", Physical Review Letters, Dec. 17, 2004, vol. 93, pp. 255506-1-255506-4.
Szuecs et al., "Mechanical Properties of Zr56.2Ti13.8Nb5.0Cu6.9Ni5.6Be12.5", Acta mater, 2001, vol. 49, pp. 1507-1513.
Yao et al., "Superductile bulk metallic glass", Applied Physics Letters, 2006, vol. 88, pp. 122106-1-122106-3.
Eshbach et al., "Handbook of Engineering Fundamentals", Third Edition, Wiley Engineering Handbook Series, Section 12, pp. 1114-1119, 1975.
Brochure entitled "ProCAST . . . Not Just for Castings!" Source and date unknown.
Polk et al., "The Effect of Oxygen Additions on the Properties of Amorphous Transition Metal Alloys", Rapidly Quenched Metals III, vol. 1, The Metals Society, 1978, pp. 220-230 (12 pgs).
Kawamura et al., "Full Strength Compacts by Extrusion of Glassy Metal Powder at the Supercooled Liquid State", Appl. Phys. Lett. vol. 67, No. 14, Oct. 2, 1995, pp. 2008-2010.
Kato et al., "Production of Bulk Amorphous Mg85Y10Cu5 Alloy by Extrusion of Atomized Amorphous Powder", Materials Transactions, JIM, vol. 35, No. 2, 1994, pp. 125-129.
Inoue et al., "Mg-Cu-Y Bulk Amorphous Alloys with High Tensile Strength Produced by a High-Pressure Die Casting Method", Materials Transactions, JIM, vol. 33, No. 10, 1992, pp. 937-945.
Lyman, "Forging and Casting", Metals Handbook, 8th Edition, vol. 5, 1970, pp. 285-306.
Amiya et al., "Mechanical Strength and Thermal Stability of Ti-Based Amorphous Alloys with Large Glass-Forming Ability", Materials Science and Engineering, A179/A180, 1994, pp. 692-696.
Inoue et al., "Bulky La-Al-TM (TM = Transition Metal) Amorphous Alloys with High Tensile Strength Produced by a High-Pressure Die Casting Method", Materials Transactions, JIM, vol. 34, No. 4, 1993, pp. 351-358.

* cited by examiner

FIG. 12

Table 1 | Mechanical and material properties of the new composites

| Alloy | $\sigma_{max}$ (MPa) | $\varepsilon_{tot}$ (%) | $\sigma_y$ (MPa) | $\varepsilon_y$ (%) | $E$ (GPa) | $\rho$ (g cm$^{-3}$) | $G$ (GPa) | CIT (J) | RoA (%) | $\nu$ |
|---|---|---|---|---|---|---|---|---|---|---|
| $Zr_{36.6}Ti_{31.4}Nb_7Cu_{5.9}Be_{19.1}$ (DH1) | 1,512 | 9.58 | 1,474 | 1.98 | 84.3 | 5.6 | 30.7 | 26 | 44 | 0.371 |
| $Zr_{38.3}Ti_{32.9}Nb_{7.3}Cu_{6.2}Be_{15.3}$ (DH2) | 1,411 | 10.80 | 1,367 | 1.92 | 79.2 | 5.7 | 28.8 | 40 | 50 | 0.373 |
| $Zr_{39.6}Ti_{33.9}Nb_{7.6}Cu_{6.4}Be_{12.5}$ (DH3) | 1,210 | 13.10 | 1,096 | 1.62 | 75.3 | 5.8 | 27.3 | 45 | 46 | 0.376 |
| $Zr_{41.2}Ti_{13.8}Cu_{12.5}Ni_{10}Be_{22.5}$ (Vitreloy 1) | 1,737 | 1.98 | – | – | 97.2 | 6.1 | 35.9 | 8 | 0 | 0.355 |
| $Zr_{56.2}Ti_{13.8}Nb_{5.0}Cu_{6.9}Ni_{5.6}Be_{12.5}$ (LM 2) | 1,302 | 5.49 | 1,046 | 1.48 | 78.8 | 6.2 | 28.6 | 24 | 22 | 0.375 |

A comparison of the alloys DH1, DH2 and DH3, Vitreloy 1, and the *in situ* composite of refs 8 and 9 (LM2). The properties listed are yield strength ($\sigma_y$), ultimate tensile strength ($\sigma_{max}$), yield strain ($\varepsilon_y$), total strain to failure ($\varepsilon_{tot}$), reduction in area (RoA), density ($\rho$), modulus of elasticity ($E$), shear modulus ($G$), Charpy impact toughness (CIT) and Poisson's ratio ($\nu$).

SEMI-SOLID PROCESSING OF BULK METALLIC GLASS MATRIX COMPOSITES

CROSS-REFERENCE TO RELATED APPLICATIONS

The current application claims priority to U.S. Provisional Application No. 60/922,194, filed Apr. 6, 2007, the disclosure of which is incorporated herein by reference.

STATEMENT OF FEDERAL FUNDING

The U.S. Government has certain rights in this invention pursuant to an NDSEG fellowship awarded by the Department of Defense.

FIELD OF THE INVENTION

The current invention is directed to a method of forming bulk metallic glass engineering materials; and more particularly to a method for forming coarsening microstructures within said engineering materials.

BACKGROUND OF THE INVENTION

The selection and design of modern high-performance structural engineering materials is driven by optimizing combinations of mechanical properties such as strength, ductility, toughness, elasticity and requirements for predictable and graceful failure in service. (See, e.g., Asby, M. F. *Materials Selection in Mechanical Design*, Chapter 6, Pergamon, Oxford, 1992). Highly processable bulk metallic glasses (BMGs) are a new class of engineering materials and have attracted significant technological interest. (See, e.g., Peker, A. & Johnson, W. L., *Appl. Phys. Lett.* 63, 2342-2344 (1993); Johnson, W. L., *MRS Bull.* 24, 42-56 (1999); Ashby, M. F. & Greer, A. L., *Scr. Mater.* 54, 321-326 (2006); Salimon, A. I. et al., *Mater. Sci. Eng. A* 375, 385-388 (2004); and Greer, A. L., *Science* 267, 1947-1953 (1995), the disclosures of which are incorporated herein by reference.) Although many BMGs exhibit high strength and show substantial fracture toughness, they lack ductility and fail in an apparently brittle manner in unconstrained loading geometries. (See, Rao, X. et at., *Mater. Lett.* 50, 279-283 (2001), the disclosure of which is incorporated herein by reference.) For instance, some BMGs exhibit significant plastic deformation in compression or bending tests, but all exhibit negligible plasticity (<0.5% strain) in uniaxial tension.

UniaxiaL compression tests are often used to assess the ductility of BMG materials to distinguish them from glassy alloys, which all lack tensile ductility. (See, e.g., Liu, Y. H. et al., *Science* 315, 1385-1388 (2007); Hofmann, D. C., Duan, G. & Johnson, W. L., *Scr. Mater.* 54, 1117-1122 (2006); Fan, C. & Inoue, A., *Appl. Phys. Lett.* 77, 46-48 (2000); Eckert, J. et al., *Intermetallics* 10, 1183-1190 (2002); He, G., Löser, W. & Eckert, J., *Scr. Mater.* 48, 1531-1536 (2003); Lee, M. H. et al., *Mater. Lett.* 58, 3312-3315 (2004); Lee, M. H. et al., *Intermetallics* 12, 1133-1137 (2004); Das, J. et al., *Phys. Rev. Lett.* 94, 205501 (2005); Yao, K. F. et al., *Appl. Phys. Lett.* 88, 122106 (2006); Eckert, J. et at., *Intermetallics* 14, 876-881 (2006); Chen, M. et al., *Phys. Rev. Lett.* 96, 245502 (2006); and Lee, S. Y. et al., *J. Mater. Res.* 22, 538-543 (2007), the disclosures of which are incorporated herein by reference.) Under compression, an operating shear band is subject to a normal stress that closes the band. Variations in local material properties caused, for example, by nanoscale inhomogeneities and frictional forces (due to closing stresses) combine to arrest persistent slip on individual shear bands. Multiple shear bands are sequentially activated, giving rise to global plasticity (~1-10% strain).

A geometry that better differentiates the ductility is bending. Here, the sample is subject to both compressive and tensile stresses. Shear bands initiate on the tensile surface but are arrested as they propagate towards the neutral stress axis. (See, e.g., Conner, R. D. et al., *J. Appi. Phys.* 94, 904-911 (2003); and Ravichandran, G. & Molinari, A., *Acta Mater.* 53, 4087-4095 (2005), the disclosures of which are incorporated herein by reference.) Deformation is stable unless the shear band at the tensile surface evolves to an opening crack. (See, e.g., Conner, R. D. et al., *Acta Mater.* 52, 2429-2434 (2004), the disclosure of which is incorporated herein by reference.) In bending, plasticity is greatly enhanced when the characteristic dimension $R_P$ of a crack tip's 'plastic zone' exceeds ~D/2, where D is sample thickness and $R_P$ is a material length scale related to fracture toughness. For a mode I opening crack, it can be expressed as Equation 1 (For discussion see, Myers, M. A. *Mechanical Metallurgy: Principles and Applications* (Prentice Hall, Englewood Cliffs, N.J., 1984), the disclosure of which is incorporate herein by reference) below:

$$R_P(1/2)(K_{1C}/_Y)^2 \quad \text{(Eq. 1)}$$

$R_P$ varies from ~1 m up to ~1 mm on going from relatively brittle to tough BMGs. (See, Lewandowski, J. J., Wang, W. H. & Greer, A. L., *Phil. Mag. Lett.* 85, 77-87 (2005), the disclosure of which is incorporated herein by reference.) $R_P$ is associated with the maximum spatial extension (band length) of shear bands originating at an opening crack tip. For a specific geometry (for example, a mode I opening crack in tension tests), $R_P$ is related to a maximum allowable shear offset along the band. In bending, the most ductile BMG reported is $Pt_{57.5}Cu_{14.7}Ni_{5.3}P_{22.5}$, with $R_P \approx 0.5$ mm ($K_{1C}$=83 MPa $m^{1/2}$). A 4-mm-thick square beam showed 3% plastic bending strain without cracking. (See, Schroers, J. & Johnson, W. L., *Phys. Rev. Lett.* 93, 255506 (2004), the disclosure of which is incorporated herein by reference.) Despite large bending and compressive ductility, the $Pt_{57.5}Cu_{14.7}Ni_{5.3}P_{22.5}$ glass has negligible (<0.5%) ductility in uniaxial tensile tests. In tension, the opening stress on the shear bands enhances strain softening and instability, frictional forces are absent, and a propagating shear band lengthens and slips without limit. Cavitation ultimately ensues within the slipping band and an opening failure follows.

Suppression of tensile instability requires a mechanism to limit shear band extension. Bending produces an inherently inhomogeous stress state where a shear band is arrested by the gradient in applied stress, $=2_Y/D$. Stability against crack opening is geometrically ensured when $D/2<R_P$. Under uniaxial tension, applied stress is uniform. By introducing inhomogeneity in elastic or plastic material properties at a microstructural length scale L, 'microstructural' stabilization mechanisms become possible. Shear bands initiated in plastically soft regions (with lower $_Y$ or lower shear modulus G) can be arrested in surrounding regions of higher yield stress or stiffness. Stabilization requires that $L \approx R_P$. This fundamental concept underlies enhancement of ductility and toughening and is similar to that used in the toughening of plastic by inclusion of rubber particles. (See, e.g., Liang, J. Z. & Li, R. K. Y., *J. Appl. Polym. Sci.* 77, 409-417 (2000), the disclosure of which is incorporated herein by reference).

To overcome brittle failure in tension, BMG-matrix composites have been introduced. BMG matrix compositions have inhomogeneous microstructures incorporated within an amorphous matrix material. These inhomogeneous microstructures, sometimes with isolated dendrites, stabilize the glass against the catastrophic failure associated with unlimited extension of a shear band and results in enhanced global plasticity and more graceful failure. Tensile strengths of ~1 GPa, tensile ductility of ~2-3 percent, and an enhanced mode I fracture toughness of $K_{1C}$≈40 MPa $m^{1/2}$ were reported. (See, e.g., Hays, C. C., Kim, C. P. & Johnson, W. L., *Phys. Rev. Lett.* 84, 2901-2904 (2000); and Szuecs, F., Kim, C. P. & Johnson, W. L., *Acta Mater.* 49, 1507-1513 (2001), the disclosures of which are incorporated herein by reference.) For example, a BMG matrix composite was discovered in $La_{74}Al_{14}(Cu,Ni)_{12}$ whereby 5% tensile ductility was achieved with 50% volume fraction of soft second phases. (See, e.g., Lee, M. L. et al., *Acta Mater.* 52, 4121-4131 (2004), the disclosure of which is incorporated herein by reference.) Although the La-based composite exhibited an ultimate tensile strength of only 435 MPa, the alloy demonstrated that the properties of the monolithic metallic glass ($La_{62}Al_{14}(Cu,Ni)_{24}$) could be greatly improved through the introduction of a soft second phase. Other desirable composite systems are those with lower density (as with Al-containing alloys) or with higher strength (as with Fe-based alloys). However, to this point it has not been possible to introduce these inhomogeneous microstructures in a controlled manner, i.e., to obtain engineered BMG matrix materials. Accordingly, a need exists for a method to design composites BMG materials.

SUMMARY OF THE INVENTION

The current invention is directed to a method of forming bulk metallic glass engineering materials; and more particularly to a method for forming coarsening microstructures within said engineering materials.

In one embodiment, the current invention is directed to a method of forming a bulk metallic glass composite material comprising the steps of:

(a) providing a bulk metallic glass comprising a plurality of dendrites dispersed within a glassy matrix, said bulk metallic glass being provided at a temperature below the glass transition temperature of the bulk metallic glass;

(b) heating the bulk metallic glass to a composite formation temperature above the solidus temperature and below the liquidus temperature of the bulk metallic glass such that the glassy phase of the bulk metallic melts to form a bulk metallic glass solution comprising the plurality of dendrites homogenously distributed within the liquid glassy phase;

(c) holding the bulk metallic glass at the composite formation temperature until the microstructural length of the plurality of dendrites increases in accordance with the Lever Rule until a maximum length is reached; and (d) quenching the bulk metallic glass to below the glass transition temperature of the bulk metallic glass to form a bulk metallic glass composite material comprising the plurality of dendrites homogenously disposed within the glassy matrix.

In another embodiment, the current invention is directed to a method using a bulk metallic glass comprising Zr—Ti—Nb—Cu—Be. In one such embodiment the bulk metallic glass has a composition comprising 15 to 60 at. % zirconium, 10 to 75 at. % titanium, 2 to 15 at. % niobium, 1 to 15 at. % copper and 0.1 to 40 at. % beryllium. In such an embodiment the dendrites have a composition comprising 35 to 50 at. % zirconium, 35 to 50 at. % titanium, 10 to 20 at. % niobium, and 0 to 3 at. % copper.

In another embodiment, the current invention is directed to a method using a bulk metallic glass selected from the group consisting of $Zr_{36.6}Ti_{31.4}Nb_7Cu_{5.9}Be_{19.1}$, $Zr_{38.3}Ti_{32.9}Nb_{7.3}Cu_{6.2}Be_{15.3}$ and $Zr_{39.6}Ti_{33.9}Nb_{7.6}Cu_{6.4}Be_{12}$.

In still another embodiment, the current invention uses a heating method selected from the group consisting of induction coil, plasma arc and oven heating.

In yet another embodiment, the current invention uses a cooling rate during quenching in a range of from 1 to 100 K/s.

In still yet another embodiment, the current invention produces a bulk metallic glass composite having dendrites with a branch diameter that ranges from about 10 to 200 microns. In another such embodiment the dendrites have a particle size of each branch of from 5 to 500 microns. In yet another such embodiment the dendrites are radially isotropic.

In still yet another embodiment, the current invention produces a bulk metallic glass composite having a volume fraction of dendrites range from less than 1% to about 95%.

In still yet another embodiment, the current invention produces a bulk metallic glass composite wherein the size of the dendrites vary by less than 20%.

In still yet another embodiment, the current invention comprises mechanically deforming the bulk metallic glass composite to further customize the nature of the dendrites.

In still yet another embodiment, the current invention produces a bulk metallic glass composite having at least one of the following properties a tensile ductility from 0 to 20%, a total strain to failure from 1.5 to 25%, a Charpy impact toughness of greater than 25 J, a plane strain fracture toughness of greater than 100 MPa*$m^{1/2}$, a room temperature rolling of greater than 5%, a reduction in area of greater than 20% during tension testing, a shear modulus of less than 30 Gpa, a fracture energy of at least 300 kJ $m^{-2}$, a homogeneous deformation during tension testing with shear band size less than 10 micron, and a supercooled liquid region of around 110 K.

In still yet another embodiment, the current invention produces a bulk metallic glass composite having a single eutectic crystallization event, a single melting event, or both.

BRIEF DESCRIPTION OF THE INVENTION

Figure 2:
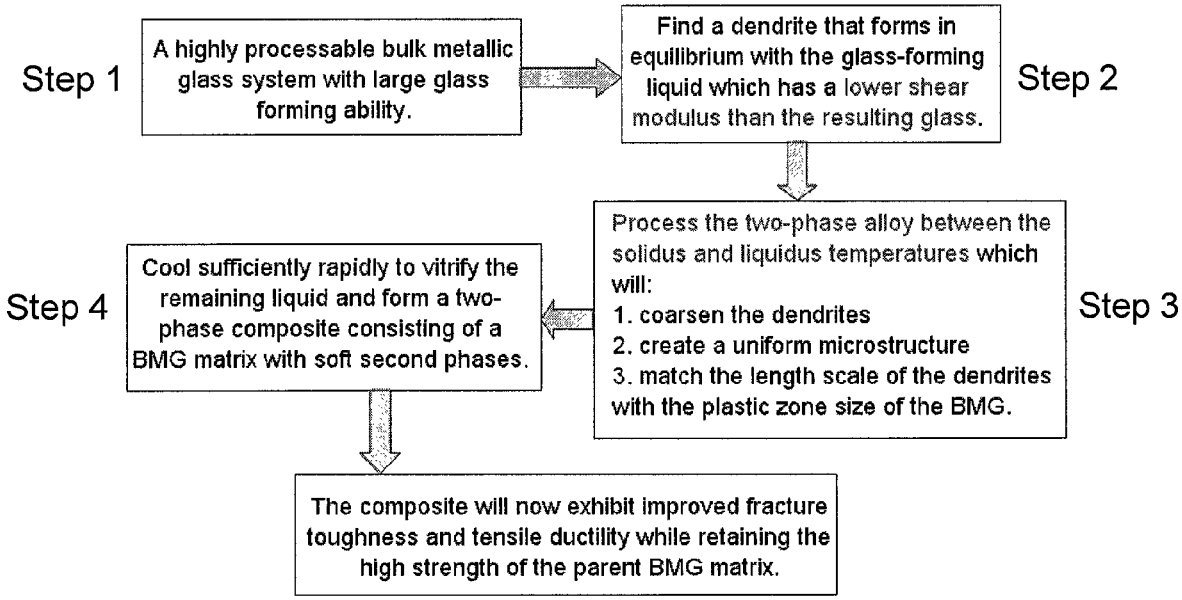
Figure 3:
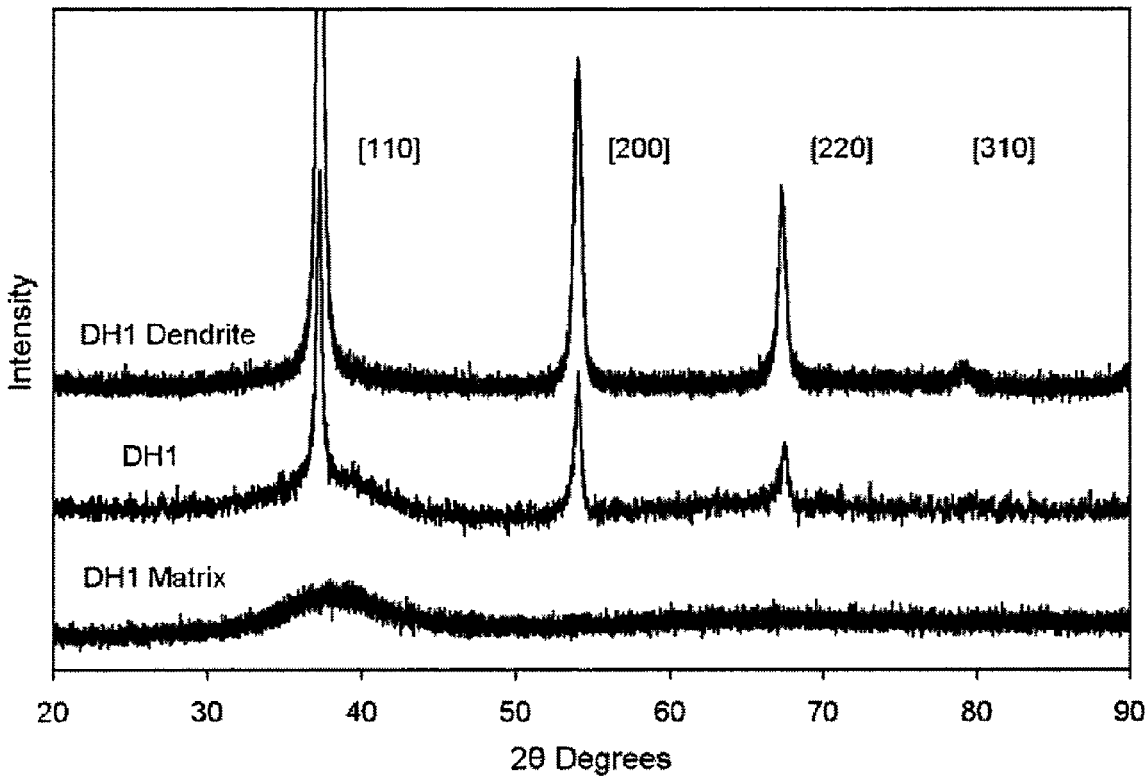
Figure 4:
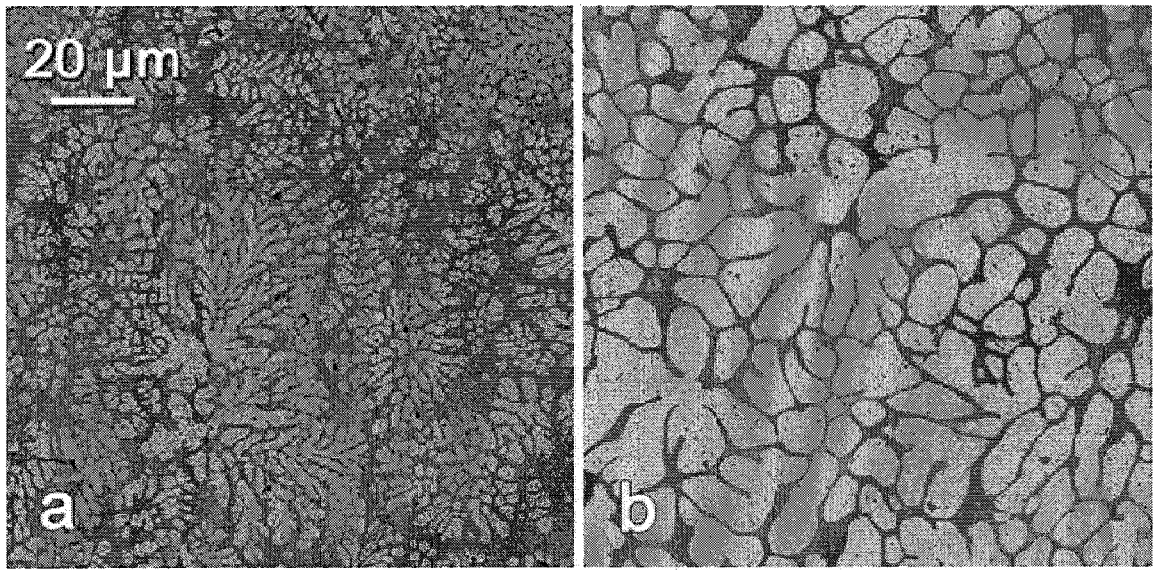
Figure 5:
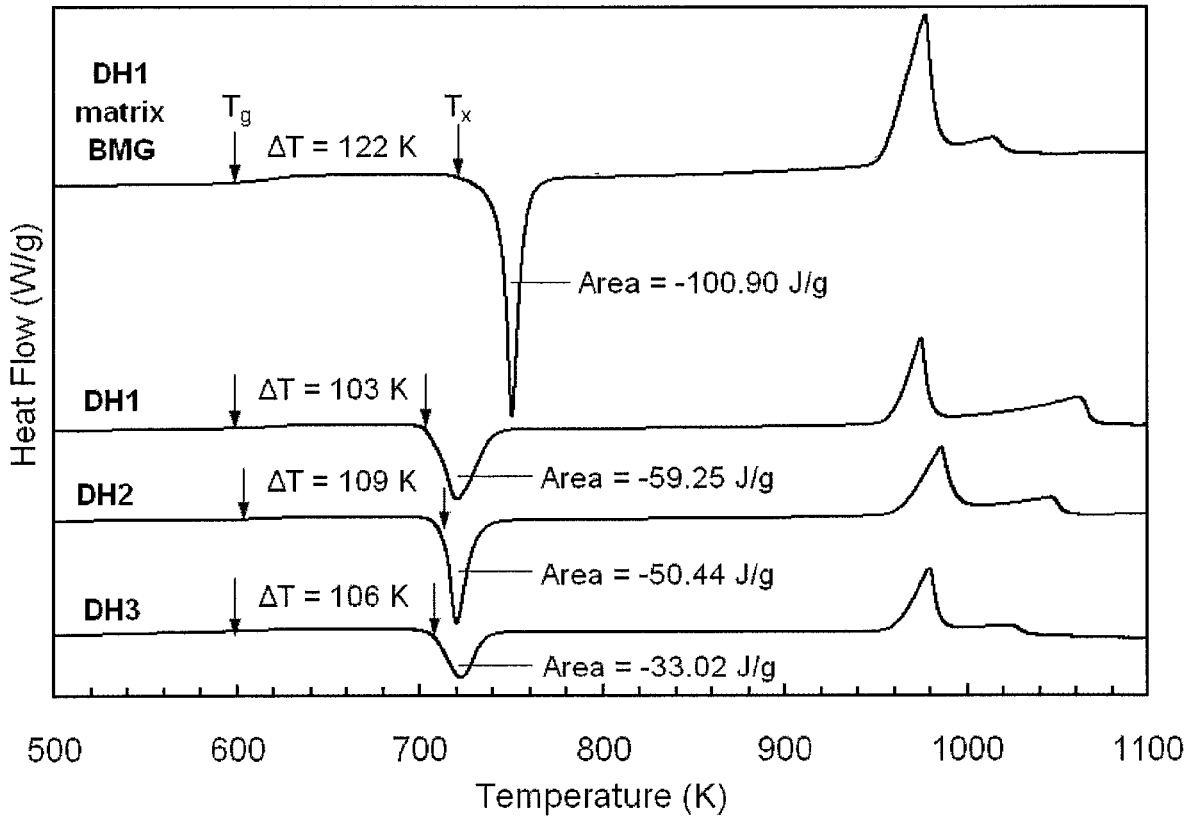
Figure 6:
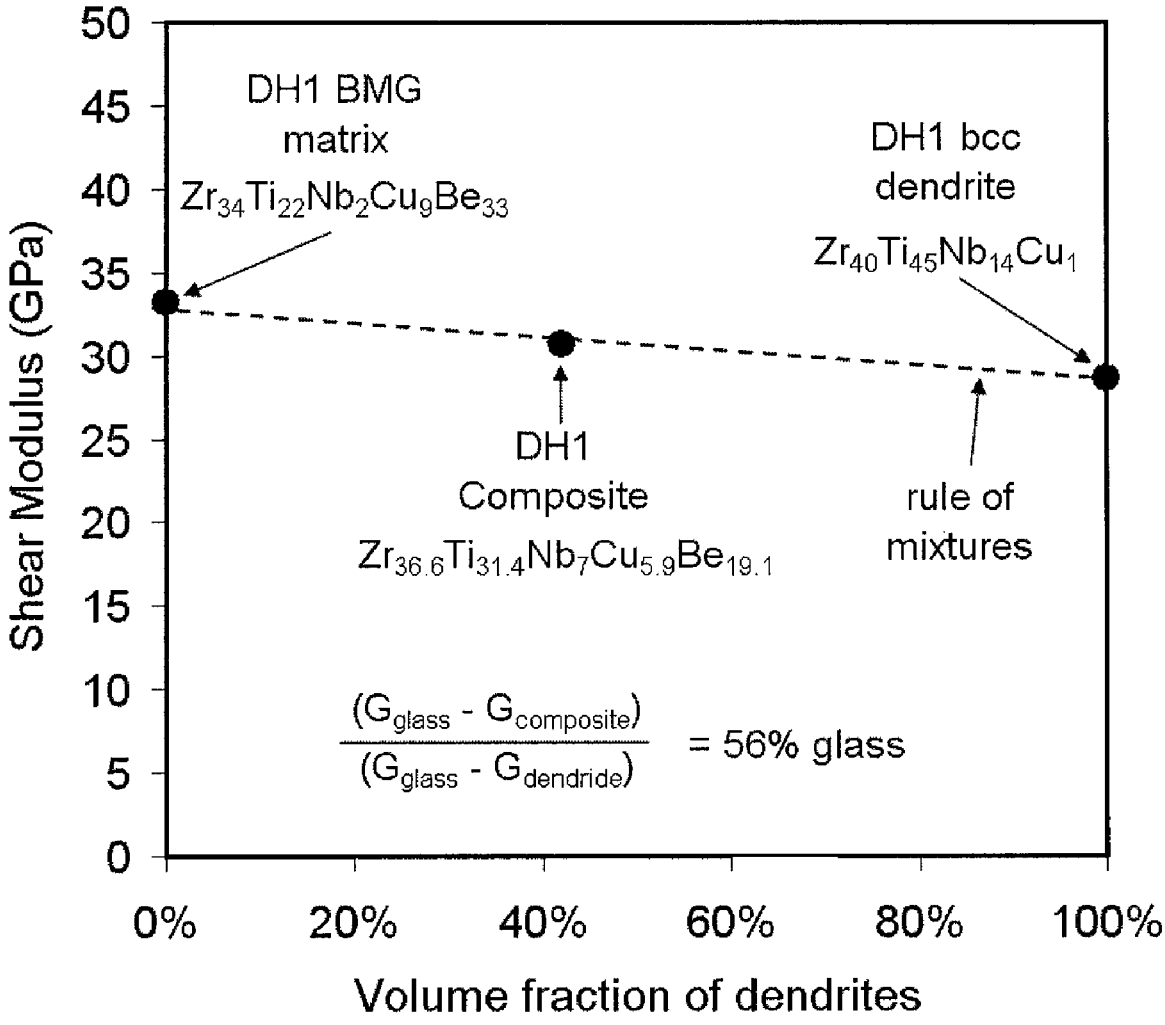
Figure 7:
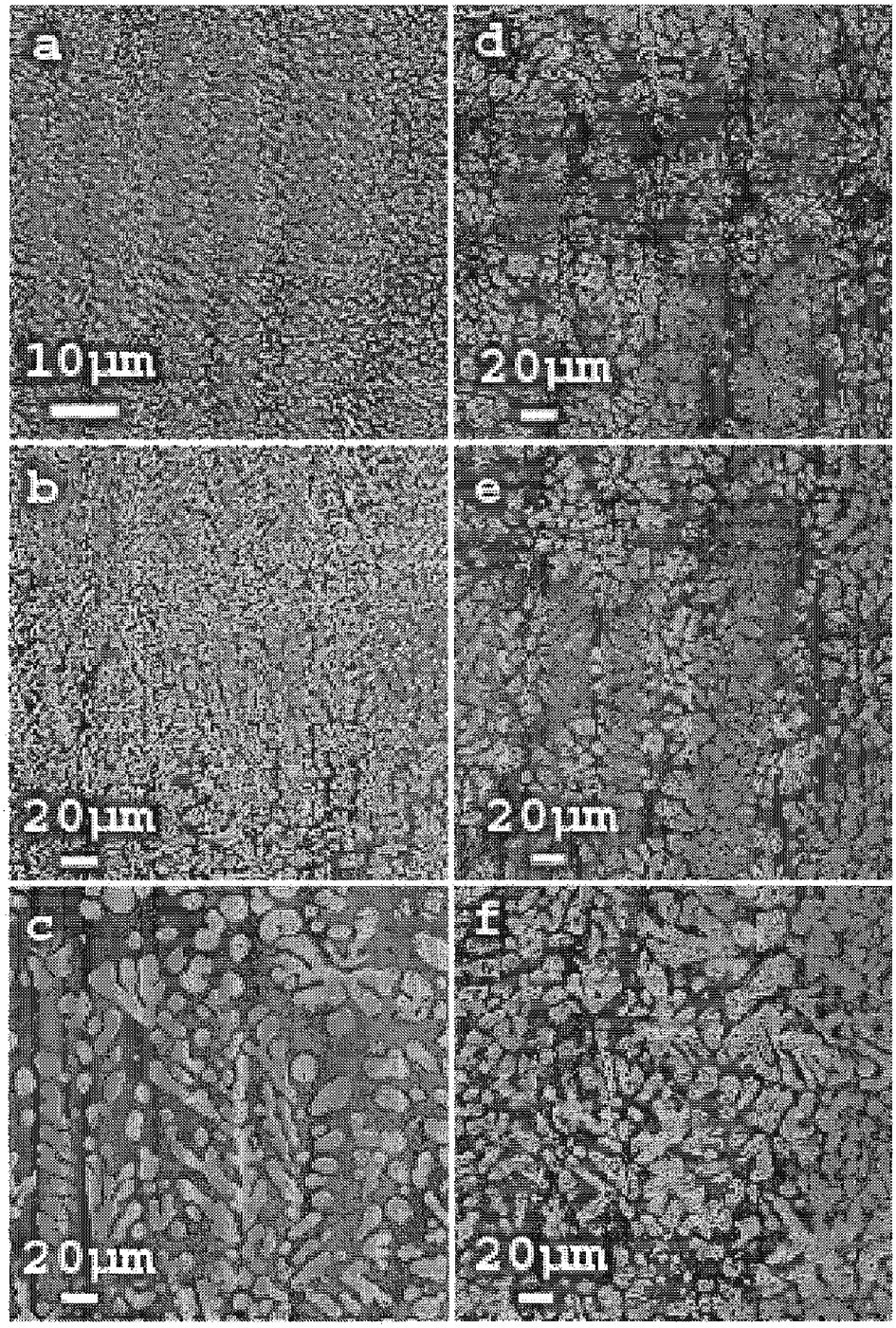
Figure 8:
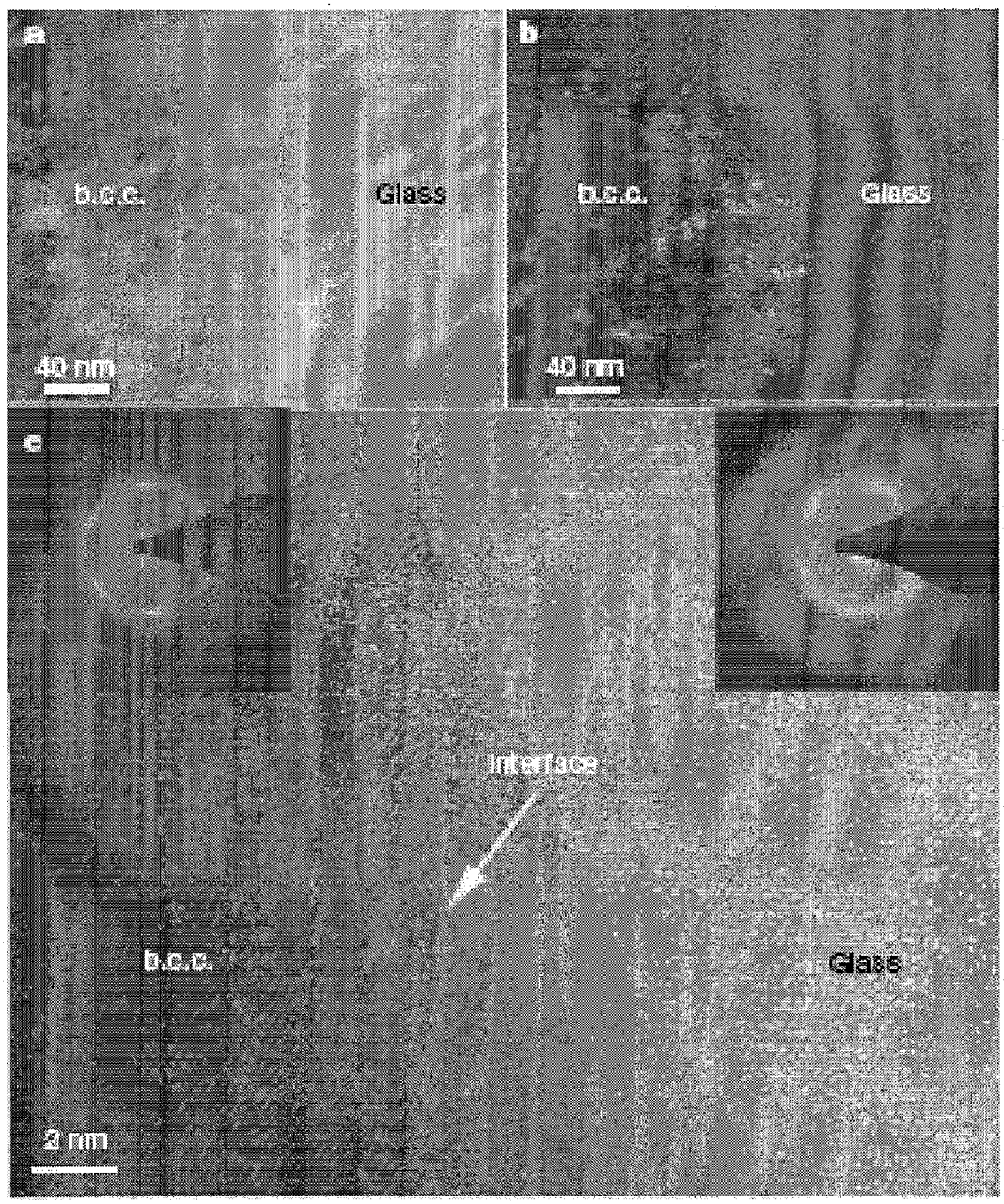
Figure 9:
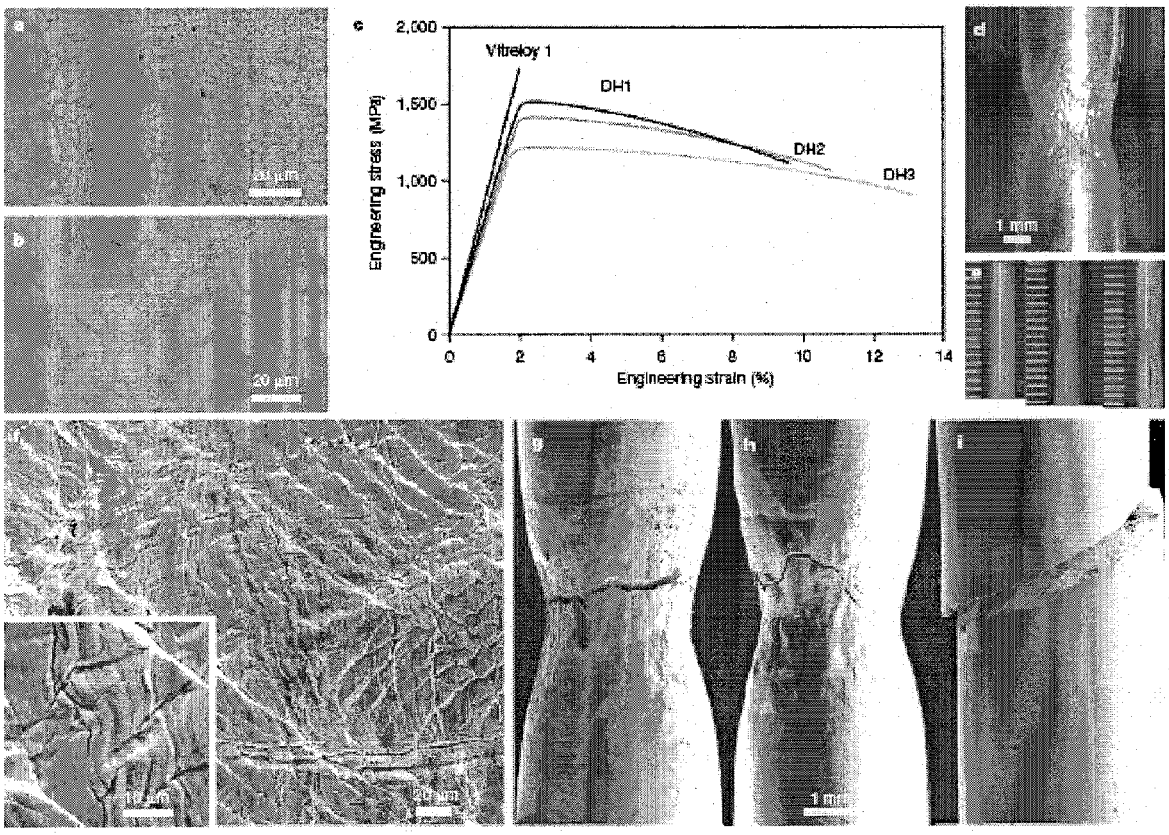
Figure 10:
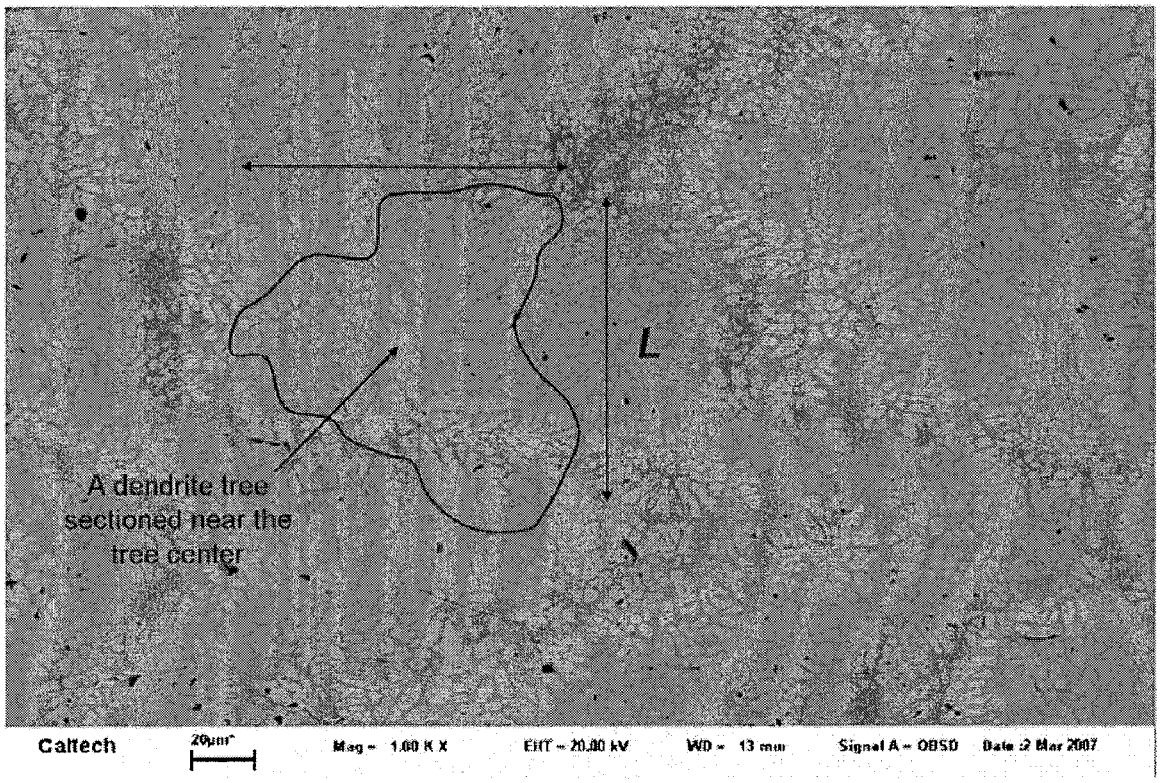
Figure 11:
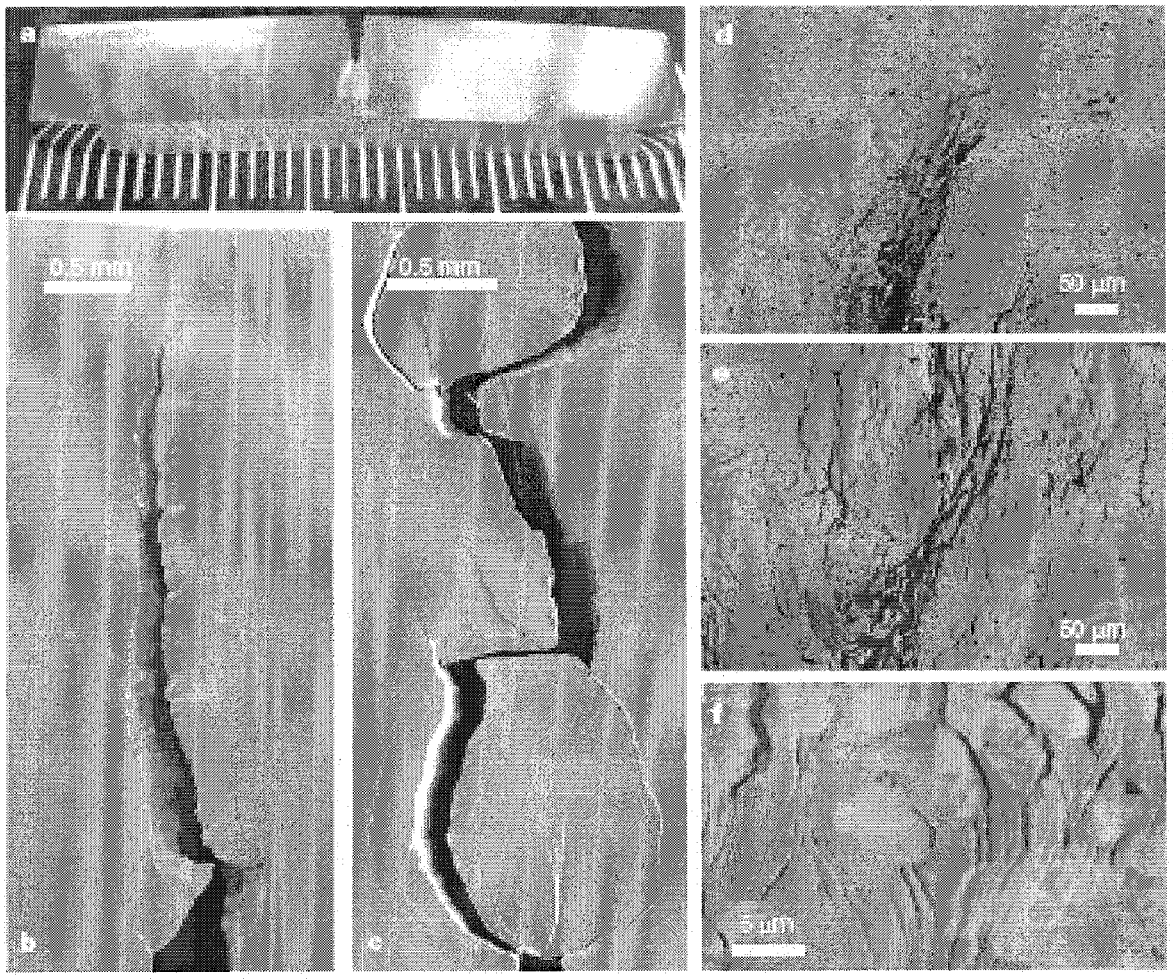

The description will be more fully understood with reference to the following figures and data graphs, which are presented as exemplary embodiments of the invention and should not be construed as a complete recitation of the scope of the invention, wherein:

FIG. 1 provides an Ashby plot for BMG composite materials made in accordance with the current invention, where the dashed contour lines separated by an order of magnitude of $G_{1C}$;

FIG. 2 provides a flowchart of an exemplary method of forming BMG composite materials in accordance with the current invention;

FIG. 3 provides X-ray diffraction data for DH1 showing the bcc dendrite material, the fully amorphous glass matrix and the composite;

FIG. 4 provides contrast adjusted backscattered SEM micrographs of (a) DH1 with composition $(Zr_{45.2}Ti_{38.8}Nb_{8.7}Cu_{7.3})_{80.9}Be_{19.1}$, and (b) a higher volume fraction alloy with composition $(Zr_{45.2}Ti_{38.8}Nb_{8.7}Cu_{7.3})_{91}Be_9$;

FIG. 5 provides DSC curves from the alloys DH1-3 and the glass matrix of DH1;

FIG. 6 provides a plot of shear modulus versus volume fraction of dendrites for the alloy DH1, its glass matrix and its dendrite;

FIG. 7 provides SEM micrographs comparing a dendrite microstructure formed by an uncontrolled prior art process (a to c), and a microstructure formed by the semi-solid processing in accordance with the current invention (e to f);

FIG. 8 provides high-resolution TEM images from the alloy DH1, (a) shows a bright-field TEM micrograph showing a b.c.c. dendrite in the glass matrix, (b) shows the corresponding dark-field micrograph of the same region, and (c) shows a high-resolution micrograph showing the interface between the two phases, with corresponding diffraction patterns shown in the inset;

FIG. 9 provides backscattered SEM micrographs showing the microstructure of DH1 (*a*) and DH3 (*b*) where the dark contrast is from the glass matrix and the light contrast is from the dendrites, (*c*) shows an engineering stress-strain curves for Vitreloy 1 and DH1, DH2 and DH3 in room-temperature tension tests, (*d*) shows an optical micrograph of necking in DH3, (*e*) shows an optical micrographs showing an initially undeformed tensile specimen contrasted with DH2 and DH3 specimens after tension testing, (*f*) shows an SEM micrograph of the tensile surface in DH3 with higher magnification shown in the inset, (*g*) and (*h*) show SEM micrographs of necking in DH2 and DH3 respectively, and (*i*) shows brittle fracture representative of all monolithic BMGs;

FIG. 10 provides a backscattered SEM micrograph of the microstructure of DH1 showing a single dendrite tree, which has been cross-sectioned near its central nucleation point illustrated with the dark curve;

FIG. 11 provides evidence of the high fracture toughness obtained by matching of key fundamental mechanical and microstructural length scales, where (a) shows an optical image of an unbroken fracture toughness ($K_{1C}$) specimen in DH1, showing plasticity around the crack tip of the order of several millimetres, (b) shows an SEM micrograph of an arrested crack in DH1 during a $K_{1C}$ test, (c) shows an SEM micrograph of $K_{1C}$ test in Vitretoy 1, (d) and (e) show backscattered SEM micrographs showing the plastic zone in front of the crack in DH1 and DH3 respectively, and (f) shows a higher-magnification SEM micrograph of DH3, showing shear bands of the order of 0.3-0.9 μm; and FIG. 12 provides a comparison of the properties of three alloys formed in accordance with the current invention (DH1, DH2 & DH3) and two conventional alloys (Vitreloy 1 and LM2).

DETAILED DESCRIPTION OF THE INVENTION

The current invention is directed to a method of forming bulk metallic glass engineering materials; and more particularly to a method for forming coarsening microstructures within said engineering materials. Specifically, the current invention provides a method for preparing 'designed composites' by matching fundamental mechanical and microstructural length scales. Using the method in accordance with the current invention, an exemplary titanium-zirconium-based BMG composite is demonstrated having room-temperature tensile ductility exceeding 10 percent, yield strengths of 1.2-1.5 GPa, $K_{1C}$ up to ~170 MPa $m^{1/2}$ and fracture energies for crack propagation as high as $G_{1C}$≈340 kJ $m^{-2}$. The $K_{1C}$ and $G_{1C}$ values equal or surpass those achievable in the toughest titanium or steel alloys, placing the BMG composites made in accordance with the current invention among the toughest known materials.

In summary, the current invention is directed to a method of forming BMG composites using microstructural toughening and ductility enhancement in metallic glasses. The two basic principles are: (1) introduction of 'soft' elastic/plastic inhomogeneities in a metallic glass matrix to initiate local shear banding around the inhomogeneity; and (2) matching of microstructural length scales (for example, L and S) to the characteristic length scale $R_P$ (for plastic shielding of an opening crack tip) to limit shear band extension, suppress shear band opening, and avoid crack development.

Using the method of the current invention it is possible to produce BMG composite alloys having vastly superior physical properties. To illustrate the unusual properties of the composites made in accordance with the current invention, an 'Ashby Map', used for selection of materials in load, deflection and energy-limited structural applications, is shown in FIG. 1. The parallel dashed lines correspond to constant $G_{1C}$ contours. The plot shows a large range of common engineering materials along with selected metallic glass ribbons and BMGs. Whereas the $K_{1C}$ values of the alloys made in accordance with the current invention are comparable to those of the toughest steels and crystalline Ti alloys. Owing to their high $K_{1C}$ and low stiffness, the semi-solidly processed composites DH1, DH2 and DH3 (Zr—Ti—Nb—Cu—Be) have among the highest $G_{1C}$ values of all known engineering materials. Indeed, the $G_{1C}$ values appear to pierce the limiting envelope defined by all alloys. In other words, the new BMG composites have benchmark $G_{1C}$ values.

A detailed discussion of the method in accordance with the current invention is described with reference to the flowchart provided in FIG. 2. As shown, in a first step a homogeneous mixture of the desired elements (e.g., Zr, Ti, Nb, Cu, Be) in any fully mixed state are heated from a temperature less than the glass transition of the glassy phase (Step 1). This heating can be done by any suitable means, such as for example, induction coil, plasma arc or oven heating.

The alloy is then further heated until the glassy phase crystallizes and melts, leaving the soft dendrite material unchanged (Step 2). After the glass phase melts, some of the dendrite phase goes into solution (as determined by the Lever Rule). During this step the alloy can be heated to and held at any temperature between the glass melting and liquidus of the entire alloy (this temperature is defined as the temperature at which all of the dendrites have entered into solution with the liquid) (Step 3). Preferably the temperature is held between the solidus and liquidus temperature of the bulk metallic glass until the dendrites grow to a size that their microstructural length scales (for example, L and S) are matched to the characteristic length scale $R_P$ (for plastic shielding of an opening crack tip) in accordance with the Lever Rule. The alloy can be either heated or cooled via any process between the two temperatures and the amount of time the alloy is held between them can be arbitrary. The critical point is that the alloy is not taken to a molten state so that at least some of the dendrite material remains in the liquid before rapidly cooling the alloy to below the glass transition of the glassy phase (Step 4). The presence of preexisting dendrites ensures that there is no nucleation of dendrites or other phases because it is more thermodynamically favored for a dendrite to grow than for nucleation of a new dendrite. Thus, the process in accordance with the current invention produces dendrites that are grown to the full extent allowed by thermodynamics.

When the processing is complete, the alloy is cooled rapidly (1-100 K/s) to below the glass transition of the alloy. It has been surprisingly discovered that the dendrite size and distribution can be controlled by adjusting the composition of the materials and the heating method. For example, when the material is induction heated on a water cooled Cu-plate, there is a steep gradient of cooling towards the plate. This causes the trunk of the dendrite to grow in the direction of the cooling rate and the braches form cylindrically around the trunk. The diameter of the branches changes slightly as a function of cooling rate, but the overall dendrite structure is much larger than in ingots cooled from a molten state. The minimum diameter of the branches is greater than 10 microns and the maximum size is greater than 100 microns. The actual diameter of each branch, which is referred to as a particle is greater than cooling from a molten state as well. Particles are greater than 5 micron.

By comparison, processing by the method described in FIG. 2 in an arc melter produces similar dendrite sizes, but the temperature is harder to control. When the processing technique is done in the oven, the samples are quenched so there is radial cooling, not a steep gradient towards a plate. This radial cooling produces isotropic growth of dendrites in the radial direction with the same sizes and volume fractions described above.

One of the key features of the materials formed in accordance with the current invention is that the final dendrite size and the volume of dendrites in the ingot can be minutely controlled and are homogenously distributed throughout the ingot. For example, the inventive technique can be used to create vol. fractions of dendrites that range from <1% as with a monolithic metallic glass to >95% as with a pure dendrite. The dendrite branches in the new composites can also be formed to range from 10-200 micron in addition. The particle size of each branch can also be minutely controlled from 5-50 micron. The processing also creates dendrites that vary by less than 20% in size throughout the ingot. Cooling from liquid creates dendrites that change by 50,000% (from 0.1 micron to 50 micron). More specifically, in alloys cooled from a molten state, dendrite sizes vary from <0.1 microns to >50 microns (more than one order of magnitude). With the new processing technique the final dendrite size is the same order of magnitude anywhere in the sample. Thus, the tensile ductility, which is a function of dendrite size, is the same everywhere in materials produced in accordance with the invention. In contrast, in alloys cooled from a molten state, the tensile ductility is less than 1% in regions where the dendrite size is less than 10 micron. Thus, the new method can be used to produce parts with a homogeneous microstructure, while the conventional method of forming amorphous materials by cooling from a molten state cannot. Because the dendrite size stays uniform throughout the ingots, the tensile ductility improves with the increasing the volume fraction of the dendrites. The shape of the dendrites can also be altered at room temperature through mechanical deformation.

As shown in FIG. 1, the new processing and materials create unprecedented mechanical properties. Tensile ductility ranges from 0-20%, total strain to failure from 1.5-25%, Charpy impact toughness >25 J, plane strain fracture toughness >100 MPa*m^0.5, room temperature rolling >5%, a reduction in area of >20% in tension testing. The material properties of the new alloys are unique as well. They also have homogeneous deformation during tension testing with shear band size less than 10 micron. This scale and type of deformation has never before been demonstrated in an in-situ composite. The in-situ composites are also capable of arresting a crack.

The differential scanning calorimeter (DSC) scans of the new alloys are also unique. The in-situ composites have either a single eutectic crystallization event, a single melting event, or both. Previous in-situ composites had multiple crystallization and melting peaks. The new composite has a supercooled liquid region much larger than any previous in-situ composite (110 K vs. 45 K). This means the alloy can be thermoplastically processed above the glass transition temperature without crystallizing. The alloys have the potential to have a much larger supercooled liquid region as well as both a single crystallization and melting event. This means the alloys will have better glass forming ability. The alloys can already be produced greater than 1 cm thick. The liquid temperature of the glass matrix can also be lowered to below the previous in-situ composites, creating a much more processable glass. In addition, the new composites and glasses have a much higher fragility and toughness than previous alloys. This means they have lower viscosity as well.

Although the above discussion has focused on the methods of forming BMG composites, it should be understood that the composition of the material used is also very important. Specifically, the nature of the composition can alter the nature and density of dendrites in the material. For example, in-situ composites have been created in the range of Zr 15-60 at. %, Ti 10-75 at. %, Nb 2-15 at. %, Cu 1-15 at. % and Be 0.1-40 at. %. In the new alloy system, the Be content can be changed, fixing the proportion of the other elements, to change the volume fraction of dendrites. Dendrite compositions can range from Zr 35-50 at. %, Ti 35-50 at. %, Nb 10-20 at. %, Cu 0-3 at. %. Glass matrix composition can vary from Zr 15-60 at. %, Ti 10-75 at. %, Nb 2-15 at. %, Cu 1-15 at. %, and Be 0.1-40 at. %.

Although only exemplary Zr-based materials are discussed above and in the examples below, it should be understood that the principles of the method of the current invention are applicable to any number of ductile-phase reinforced metallic glass systems provided several criteria are met: the new alloy system must be a highly processable metallic glass in which a shear-soft dendritic phase nucleates and grows while the remaining liquid is vitrified on subsequent cooling.

EXAMPLES

Methodologies

The exemplary alloys formed in accordance with the current invention were prepared in a two-step process. First, ultrasonically cleansed pure elements were arc-melted under a Ti-gettered argon atmosphere. Second, the ingots were placed on a water-cooled Cu boat and heated via induction, with temperature monitored by pyrometer. The second step is used as a way of semi-solidly processing the alloys between their solidus and the liquidus temperatures. This procedure coarsens the dendrites, produces RF-stirring, and homogenizes the mixture. Samples were produced with masses up to 35 g and with thicknesses ~1 cm, based on the geometry of the Cu boat. Samples for mechanical testing were machined directly from these ingots and tests were performed in accordance with ASTM standards, where applicable. Elastic properties were measured ultrasonically.

ASTM standard tension tests were prepared in proportion with the ASTM E8M standard. The diameter of the gauge section was 3.00-3.05 mm and the gauge length was 15.15-15.25 mm. The tests were performed at room temperature on a calibrated Instron 5500R load frame. The tests were done with a constant crosshead displacement rate of 0.1 mm $min^{-1}$. The elastic strain was measured by extensometer and the total strain was measured both by a linear variable displacement transducer attached to the sample fixture and by machine crosshead. The decrease in area was measured by a Leo 1550 VP Field Emission SEM in accordance with ASTM standards.

Fracture toughness samples were prepared with dimensions 2.4-2.6 mm thick×7.6-8.4 mm wide×36 mm long and were polished for observation of surface shear bands after fracture. An initial notch was made in the middle of one side using a wire saw. From the notched end, a precrack was generated by fatigue cracking with 5 Hz of oscillating load (applied by an MTS Hydraulic machine equipped with a three-point bending fixture having 31.75 mm span distance.) The load level was kept at K≈10 MPa $m^{1/2}$, $K_{min}/K_{max}$≈0.2 and 2 mm of precrack was obtained after 40,000-100,000 cycles. With an initial crack length of 3.7-4.4 mm (the sum of the notch length and precrack), a quasi-static compressive displacement of 0.3 mm $min^{-1}$ (K≈40 MPa $m^{1/2}$/min) was applied and the load response of the pre-cracked sample was measured. Evaluation of J (a parameter of elastic-plastic fracture mechanics), and of the J-R curve, by measuring unloading compliance, were also performed during the test because the samples have extensive plasticity before the initial crack propagation. In the samples with high fracture toughness (for example, DH3), the requirement of sample dimension given by ASTM E1820 is marginally satisfied for the J evaluation. Owing to limitations in sample geometry, these J values were used to estimate $K_{1C}$. Reduced-size Charpy impact tests were machined proportional to ASTM standard E23-82. The samples were 5 mm×5 mm×55 mm in the U-notch configuration. Charpy tests were performed on a calibrated Riehle impact testing machine.

The pulse-echo overlap technique was used to measure the shear and longitudinal wave speeds at room temperature for each of the samples. The set-up included a 3500PR pulser/receiver and 5 MHz piezoelectric transducers from panametrics, a Tektronix 1500 oscilloscope, and a GPIB interface to a PC-controlled Labview program were used to capture the pulse and echo waveforms. Sound velocity samples were all greater than 3 mm in thickness and sample surfaces were polished flat and parallel to a surface finish of 9 m. Sample density was measured by the Archimedean technique according to the American Society of Testing Materials standard C 693-93. The sound velocity, density and thickness of each sample were measured multiple times and the error propagated. The errors in the calculated values of G, and E range from ±0.5-0.6% of the stated average value.

Compositions of the dendrites and glass were estimated through EDS, DSC and computer software. TEM analysis was performed at the Kavli Nanoscience Institute at the California Institute of Technology using a FEI Tecnai F30UT high-resolution TEM operated at 300 kV. Samples were prepared for TEM observation by microtoming.

Compositions

Compared to previous in situ composites, the BMG composites made in accordance with the current invention have increased Ti content to reduce density and contain no Ni. Removal of Ni enhances fracture toughness of the glass and suppresses nucleation of brittle intermetallics during processing. Three alloys-$Zr_{36.6}Ti_{31.4}Nb_7Cu_{5.9}Be_{19.1}$, $Zr_{38.3}Ti_{32.9}Nb_{7.3}Cu_{6.2}Be_{15.3}$ and $Zr_{39.6}Ti_{33.9}Nb_{7.6}Cu_{6.4}Be_{12.5}$ (DH1, DH2 and DH3)—were formed for testing herein. The Be content was varied, x=12.5-19.1 (in atom %), while fixing the mutual ratios of Zr, Ti, Nb and Cu. As x decreases, an increasing volume (or molar) fraction of dendritic phase was obtained in the glass matrix. Scanning electron microscopy (SEM), energy dispersive X-ray spectrometry (EDS) and X-ray diffraction (XRD) analysis show that the composition of the dendrites and glass matrix remain approximately constant with varying x. In the exemplary alloys formed herein the dendritic phase was a body-centred cubic (b.c.c.) solid solution containing primarily Zr, Ti and Nb, as verified by X-ray and EDS analysis, as shown in FIG. 3. Specifically, FIG. 3 shows X-ray diffraction data for DH1 showing the bcc dendrite material, the fully amorphous glass matrix and the composite, which is a superposition of the two. This result provides evidence that DH1 is thus a combination of a glass matrix and a bcc dendrite. If the glass matrix were partially crystalline, erroneous peaks would be visible in the X-ray scan of DH1. Although not shown, it should be understood that this result holds true for DH2 and DH3. Additionally, the amorphous background from the glass matrix is still visible in the scan from DH1.

Partition of DH1, DH2 and DH3 by volume fraction yielded 42%, 51% and 67% dendritic phase in a glass matrix, respectively. These percentages were obtained by analysing the contrast from SEM images using computer software, as shown in FIG. 4. Specifically, FIG. 4 shows contrast adjusted backscattered SEM micrographs of (FIG. 4*a*) DH1 with composition $(Zr_{45.2}Ti_{38.8}Nb_{8.7}Cu_{7.3})_{80.9}Be_{19.1}$ and (FIG. 4*b*) a higher volume fraction alloy with composition $(Zr_{45.2}Ti_{38.8}Nb_{8.7}Cu_{7.3})_{91}Be_8$. Since Be does not partition into the dendrite, reducing the Be in the total alloy composition leads to a smaller volume fraction of glass phase. This illustrates why the alloys DH1-3 have increasing volume fraction of dendrites, even though selected SEM micrographs may appear to show otherwise. As a note, the contrast has been increased to differentiate the two phases, making it appear as though the glass phase has a heterogeneous instead of amorphous microstructure.

These SEM scan results were also independently verified by analysing the heat of crystallization from DH1, DH2 and DH3 in differential scanning calorimetry (DSC) scans relative to the heat of crystallization from a fully glassy matrix alloy, as shown in FIG. 5. Specifically, FIG. 5 shows DSC curves from the alloys DH1-3 and the glass matrix of DH1. In each alloy, a clear glass transition is visible along with a eutectic crystallization event. The heat of crystallization in DH1-3 relative to the heat of crystallization in the matrix alloy can be used as an estimation of the volume fraction of glass. This method verifies image analysis done using computer software. Dendrite compositions measured using EDS ranged over $Zr_{40-44}Ti_{42-45}Nb_{11-14}Cu_{1-3}$, while glass matrix compositions ranged over $Zr_{31-34}Ti_{17-22}Nb_{1-2}Cu_{9-13}Be_{31-38}$. These are reported with an estimated error of 1 atom %.

As discussed above, the study also indicates that the volume fraction of the dendritic phase can be controlled by varying x from 0 to 100%. Ultrasonic measurements for the composites give average elastic constants following a 'volume rule of mixtures' with varying x, as shown in FIG. 6. Specifically, FIG. 6 provides a plot of shear modulus versus volume fraction of dendrites for the alloy DH1, its glass matrix and its dendrite. In DH1, for example, a shear modulus of G=33.2 GPa and a Young's modulus of E=89.7 GPa for the glass matrix phase and G=28.7 GPa and E=78.3 GPa for the dendritic phase were obtained. That the glass matrix has a higher shear modulus (~33 GPa) than the bcc dendrite (~28 GPa), indicates that the dendrite is a soft inclusion. The two-phase composite has a volume-weighted average value of the two, G=30.7 GPa and E=84.3 GPa. That the composite DH1 is a rule of mixtures average of the glass matrix and the dendrite, indicates that it is truly a two phase alloy. Calculating the volume fraction of glass by this method yields 56%, in excellent agreement with image analysis and DSC scans. The results are similar for DH2-3 with slightly different slopes due to the different compositions of glass matrix and dendrites. Under loading, yielding and deformation are promoted in the dendrite vicinity and limited by the surrounding matrix.

Test Results

Earlier reported in situ composites were solidified from the melt in an arc melter. Owing to cooling rate variations within the ingots, the overall dendrite length scale and interdendrite spacings showed large variation from ~1 to 100 m. As discussed above, to produce a more uniform microstructure, the exemplary alloys were heated into the semi-solid two-phase region (T=~800-900° C.) between the alloy liquidus and solidus temperature and held there isothermally for several minutes, remaining entirely below the molten state (T>1,100° C.).

A comparison of uncontrolled microstructure versus semi-solid processing is provided in FIG. 7. Specifically, FIGS. 7*a* to *c* show backscattered SEM micrographs from an approximately 7 mm thick ingot of an in-situ composite cooled on an arc-melter (reproduced from S. Lee, *Thesis; California Institute of Technology,* 2005). These images show that the dendrite size varies from 0.4-0.6 μm (top of ingot FIG. 7*a*) to 2-4 μm (middle of ingot FIG. 7*b*) to 8-12 μm (bottom of ingot FIG. 7*c*). In contrast FIGS. 7*d* to *e* show backscattered SEM micrographs from a 7 mm thick bar of DH2 produced on the water-cooled Cu-boat in the semi-solid region in accordance with the current invention. These images show that the dendrite arm size varies from only 5-15 μm throughout the entire ingot (Top FIG. 7*d*, middle FIG. 7*e* and bottom FIG. 7*f*). Accordingly this comparison demonstrates that the semi-solid processing of the current invention produces a more uniform microstructure, which varies minimally with cooling rate. Since tensile ductility rapidly falls with dendrite size, the more homogeneous microstructure of DH2 leads to a highly toughened composite.

The semi-solid mixture was then quenched sufficiently rapidly to vitrify the remaining liquid phase. This process yields a more uniform 'near-equilibrium' two-phase microstructure throughout the ingot, which was characterized using TEM, as shown in FIG. 8. A bright-field/dark-field pair showing the b.c.c. dendrite in the glass matrix is shown in FIGS. 8*a* and 8*b*, for the alloy DH1. The interface between a dendrite and the glass matrix is shown in high resolution in FIG. 8*b*. The micrograph confirms that the interface between the two phases is atomically sharp. Diffraction patterns are shown in the insets of FIG. 8*c* for both the dendrite and the matrix glass. The dendrite exhibits a b.c.c. diffraction pattern whereas the glass matrix exhibits two broad, diffuse halos typical of an amorphous material. The dendrite-glass interfaces in DH2 and DH3 are similar to those seen in FIG. 8.

SEM analysis was used to characterize the bulk microstructure of the composites. Two selected areas are shown in FIGS. 9*a* and 9*b* for the alloys DH1 and DH3. After analysing an array of micrographs, it was determined that dendrite size varied over L≈60-120 m while inter-dendrite spacings varied over S≈80-140 m. (S is the distance from the centre of a single dendrite tree to the centre of an adjacent one, and L is the total spanning length of a single dendrite tree.) One of these micrographs is reproduced in FIG. 10 and shows an estimate of the spanning length, L, for a dendrite cross-section of L ~100 μm (indicated by the arrows). Primary or secondary 'trunk' diameters noticeably increased from DH1 to DH3 with DH1 (or DH3) exhibiting a more (or less) developed tree structure. The rationale for selecting these microstructures lies in uniformly matching the length scales L and S to be less than, but of the order of, $R_P$. The $R_P$ for the glass matrix can be estimated from its $K_{1C}$≈70 MPa $m^{1/2}$ to be $R_P$≈200 m.

The room-temperature engineering stress-strain tensile curves for DH1, DH2 and DH3 (FIG. 9*c*) show total strain to failure in the range 9.6-13.1% at ultimate tensile strengths of 1.2-1.5 GPa. Sample-to-sample variation in total strain was typically ±1% and variation in strength was typically ±0.1 GPa. The stress decreases at large strains owing to necking in the gauge section. The alloy DH2 demonstrates the most necking (50% reduction in area), and fails at a true stress of 2.15 GPa in the necked region. Optical images of tensile gauge sections in DH2 and DH3 are shown in FIGS. 9*d* and 9*e*. The in situ composites exhibit plastic elongation of approximately 1.3 mm (8.6%) and 1.7 mm (11.3%) from their undeformed gauge lengths of ~15 mm. FIGS. 9*g* and 9*h* show the necked regions from DH2 and DH3 at higher magnification. In contrast, monolithic BMGs fail on a single shear band oriented at roughly 45° (FIG. 9*i*).

The observed tensile ductility of DH1, DH2 and DH3 is associated with patterns of locally parallel primary shear bands that form in domains defined by individual dendrites (FIG. 9*f*, taken near the necked region). The primary shear bands have a dominant spacing of $d_P$≈15 m, or roughly S/10 L/10. The plane of shear slip of the primary bands changes orientation (often by a 90° rotation) on moving from one dendrite domain to a neighbouring dendrite domain. The length of individual primary shear bands (~60-100 m) is of the order of L (and S), and somewhat less than, but of the order of, $R_P$. The inset of FIG. 9*f* shows a magnified image of secondary shear band patterns between two primary shear bands. Dense secondary shear bands with spacing $d_S$≈1-2 m are uniformly distributed within primary bands. It should be noted that $d_P$≈L/10 and $d_S$≈$d_P$/10. Similar geometric 'scaling' of shear band spacings is also observed for primary/secondary patterns in bending experiments.

Mode I fracture toughness tests in the three-point bend geometry ($K_{1C}$) were used to assess the resistance to crack propagation of DH1, DH2 and DH3 (FIG. 11*a*). From an initial cut notch, a pre-crack was generated by fatigue cracking. On subsequent loading, we observed extensive plasticity before crack growth. The load displacement curves start to turn over at a stress intensity of K=55-75 MPa $m^{1/2}$, but unloading compliance shows that failure at the blunted pre-crack front initiates much later. Thus, the J-integral and J-R curves were used to assess $K_{1C}$ according to method ASTM E399.A3 and formula ASTM E1820. In fact, the final propagating crack was arrested before sample failure occurred (FIG. 11*b*). This crack propagation contrasts sharply with the behaviour of monolithic BMGs (FIG. 11*c*) in which crack arrest is never observed. Although an array of shear bands form at the precrack tip, the monolithic glass fails catastrophically along a single shear band when overloaded. FIGS. 11*d* and 11*e* show backscattered SEM micrographs of the arrested crack tip in DH1 and DH3, showing a complex plastic zone with primary and secondary shear band patterns. DH3, which has the highest fracture toughness, exhibits more extensive deformation at the crack tip than DH1 (FIG. 11*d* and 11*e*).

High-resolution SEM was used to image the shear band formation in the interdendrite regions, shown in FIG. 11*f*. Primary and secondary shear band patterns are visible with spacing 5-10 μm and 0.3-0.9 μm, respectively. This matches closely with the secondary to primary shear band relation $d_S$≈$d_P$/10. The fracture toughnesses of DH1, DH2 and DH3 were estimated to be $K_{1C}$≈87 MPa $m^{1/2}$, 128 MPa $m^{1/2}$ and 173 MPa $m^{1/2}$. DH1, DH2 and DH3 have high $K_{1C}$ in load-limited failure, but have extremely high values of $G_{1C}$ (~$K_{1C}^2$/E) in energy-limited failure (due in part to their relatively low Young's modulus). For example, the fracture toughness of DH3 is $K_{1C}$≈173 MPa $m^{1/2}$, while the fracture energy is $G_{1C}$≈341 kJ $m^{-2}$. This is comparable to $G_{1C}$ in highly toughened steels, which have stiffness nearly three times higher than DH3 (E≈200 GPa versus E=75 GPa). It should be noted that the apparent plastic zone radius $R_P$ of the composite is of the order of several millimetres (FIG. 11*a*), comparable to many structural crystalline metals.

FIG. 12 provides a table summarizing some of the properties observed for DH1, DH2 and DH3. The properties are compared with those of monolithic BMGs and with earlier reported composites (other data obtained not shown). For example, Charpy impact energies were measured and found to be of the order of 40-50 J $cm^{-2}$, much higher than values for either monolithic glass or previous composites (FIG. 12). Further details (backscattered SEM, XRD, DSC curves and optical images) of the current alloys are shown in the Supplementary Information.

SUMMARY

In summary, the current invention is directed to a method of forming BMG composites using microstructural toughening and ductility enhancement in metallic glasses. The two basic principles are: (1) introduction of 'soft' elastic/plastic inhomogeneities in a metallic glass matrix to initiate local shear banding around the inhomogeneity; and (2) matching of microstructural length scales (for example, L and S) to the characteristic length scale $R_P$ (for plastic shielding of an opening crack tip) to limit shear band extension, suppress shear band opening, and avoid crack development.

While the above description contains many specific embodiments of the invention, these should not be construed as limitations on the scope of the invention, but rather as an example of one embodiment thereof. Accordingly, the scope of the invention should be determined not by the embodiments illustrated, but by the appended claims and their equivalents.

What is claimed is:

1. A method of forming a bulk metallic glass composite material comprising:

providing a bulk metallic glass comprising a plurality of dendrites dispersed within a glassy matrix, said bulk metallic glass being provided at a temperature below the glass transition temperature of the bulk metallic glass;

heating the bulk metallic glass to a composite formation temperature above the solidus temperature and below the liquidus temperature of the bulk metallic glass such that the glassy phase of the bulk metallic melts to form a bulk metallic glass solution comprising the plurality of dendrites homogenously distributed within the liquid glassy phase;

holding the bulk metallic glass at the composite formation temperature until the microstructural length of the plurality of dendrites increases until said microstructural length is on the order of the theoretical length scale ($R_p$) for plastic shielding of an opening crack tip for the bulk metallic qlass; and quenching the bulk metallic glass to below the glass transition temperature of the bulk metallic glass to form a bulk metallic glass composite material comprising the plurality of dendrites homogenously disposed within the glassy matrix.

2. The method of claim 1 wherein the bulk metallic glass is a Zr—Ti—Nb—Cu—Be bulk metallic glass.

3. The method of claim 1, wherein the heating is performed by a method selected from the group consisting of induction coil, plasma arc and oven heating.

4. The method of claim 1, wherein cooling rate during quenching is in a range of from 1 to 100 K/s.

5. The method of claim 1, wherein the dendrites have a branch size that ranges from about 10 to 200 microns.

6. The method of claim 5, wherein the dendrites have a particle size of each branch of from 5 to 500 microns.

7. The method of claim 1, wherein the dendrites are radially isotropic.

8. The method of claim 1, wherein volume fraction of dendrites range from less than 1% to about 95%.

9. The method of claim 1, wherein the size of the dendrites vary by less than 20%.

10. The method of claim 1, further comprising mechanically deforming the bulk metallic glass composite.

11. The method of claim 1, wherein the bulk metallic glass composite has a tensile ductility from 0 to 20%.

12. The method of claim 1, wherein the bulk metallic glass composite has a total strain to failure from 1.5 to 25%.

13. The method of claim 1, wherein the bulk metallic glass composite has a Charpy impact toughness of greater than 25 J.

14. The method of claim 1, wherein the bulk metallic glass composite has a plane strain fracture toughness of greater than 100 $MPa*m^{1/2}$.

15. The method of claim 1, wherein the bulk metallic glass composite has a room temperature rolling properties of greater than 5%.

16. The method of claim 1, wherein the bulk metallic glass composite has a reduction in area of greater than 20% during tension testing.

17. The method of claim 1, wherein the bulk metallic glass composite has a shear modulus of less than 30 Gpa.

18. The method of claim 1, wherein the bulk metallic glass composite has a fracture energy of at least 300 kJ $m^{-2}$.

19. The method of claim 1, wherein the bulk metallic glass composite has a homogeneous deformation during tension testing with shear band size less than 10 micron.

20. The method of claim 1, wherein the bulk metallic glass composite has one of either a single eutectic crystallization event or a single melting event.

21. The method of claim 1, wherein the bulk metallic glass composite has both a single eutectic crystallization event and a single melting event.

22. The method of claim 1, wherein the bulk metallic glass composite has a supercooled liquid region of around 110 K.

23. The method of claim 1, wherein the glassy matrix has a composition comprising 15 to 60 at. % zirconium, 10 to 75 at. % titanium, 2 to 15 at. % niobium, 1 to 15 at. % copper and 0.1 to 40 at. % beryllium.

24. The method of claim 1, wherein the dendrites have a composition comprising 35 to 50 at. % zirconium, 35 to 50 at. % titanium, 10 to 20 at. % niobium, and 0 to 3 at. % copper.

25. The method of claim 1, wherein the bulk metallic glass is a composition selected from the group consisting of $Zr_{36.6}Ti_{31.4}Nb_7Cu_{5.9}Be_{19.1}$, $Zr_{38.3}Ti_{32.9}Nb_{7.3}Cu_{6.2}Be_{15.3}$ and $Zr_{39.6}Ti_{33.9}Nb_{7.6}Cu_{6.4}Be_{12}$.

* * * * *

UNITED STATES PATENT AND TRADEMARK OFFICE

CERTIFICATE OF CORRECTION

PATENT NO. : 7,883,592 B2
APPLICATION NO. : 12/059523
DATED : February 8, 2011
INVENTOR(S) : Douglas C Hofmann It is certified that error appears in the above-identified patent and that said Letters Patent is hereby corrected as shown below:

Claim 1, line 45, after the word metallic, delete "qlass" and add --glass--.
Claim 17, line 30, after the word less than, delete "Gpa" and add --GPa--.
Claim 19, line 35, after the word less than, delete "micron" and add --microns--.

Signed and Sealed this
Twenty-sixth Day of February, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 7,883,592 B2
APPLICATION NO. : 12/059523
DATED : February 8, 2011
INVENTOR(S) : Douglas C Hofmann It is certified that error appears in the above-identified patent and that said Letters Patent is hereby corrected as shown below:

Claim 1, Column 13, line 45, after the word metallic, delete “qlass” and add --glass--.
Claim 17, Column 14, line 30, after the word less than, delete “Gpa” and add --GPa--.
Claim 19, Column 14, line 35, after the word less than, delete “micron” and add --microns--.

This certificate supersedes the Certificate of Correction issued February 26, 2013.

Signed and Sealed this
Nineteenth Day of March, 2013

Teresa Stanek Rea
*Acting Director of the United States Patent and Trademark Office*